US008393814B2

(12) United States Patent
Challman et al.

(10) Patent No.: US 8,393,814 B2
(45) Date of Patent: Mar. 12, 2013

(54) RETRACTABLE INSTRUMENT HAVING A TWO STAGE PROTRACTION/RETRACTION SEQUENCE

(75) Inventors: Robert G. Challman, Naperville, IL (US); Jaime Arenas, West Chicago, IL (US)

(73) Assignee: Sanford, L.P., Oak Brook, IL (US)

( * ) Notice: Subject to any disclaimer, the term of this patent is extended or adjusted under 35 U.S.C. 154(b) by 795 days.

(21) Appl. No.: 12/363,480

(22) Filed: Jan. 30, 2009

(65) Prior Publication Data

US 2010/0196080 A1 Aug. 5, 2010

(51) Int. Cl.
*B43K 24/02* (2006.01)

(52) U.S. Cl. ..... 401/108

(58) Field of Classification Search ..... 401/99, 401/107–109

See application file for complete search history.

(56) References Cited

U.S. PATENT DOCUMENTS

| | | | |
|---|---|---|---|
| 1,810,249 | A | 6/1931 | Koehler |
| 1,923,634 | A | 8/1933 | Markstein |
| 1,940,548 | A | 12/1933 | Jensen |
| 2,073,719 | A | 3/1937 | Ross |
| 2,224,470 | A | 12/1940 | Boust |
| 2,291,859 | A | 8/1942 | Andrews |
| 2,392,840 | A | 1/1946 | Groft |
| 2,401,711 | A | 6/1946 | Smith |
| 2,603,186 | A | 7/1952 | Fischer |
| 2,626,049 | A | 1/1953 | Tursky |
| 2,874,679 | A | 2/1959 | Zepelovitch |
| 2,949,887 | A | 8/1960 | Martin et al. |
| 2,957,452 | A | 10/1960 | Brannon |
| 3,035,299 | A | 5/1962 | Gordon et al. |
| 3,124,106 | A | 3/1964 | Kosta |
| 3,146,758 | A | 9/1964 | Zepell |

(Continued)

FOREIGN PATENT DOCUMENTS

| | | |
|---|---|---|
| DE | 451 884 | 11/1927 |
| DE | 623 816 | 12/1935 |

(Continued)

OTHER PUBLICATIONS

International Search Report for Application No. PCT/US2006/011014, dated Nov. 23, 2006.

(Continued)

*Primary Examiner* — Tuan N Nguyen
(74) *Attorney, Agent, or Firm* — Marshall, Gerstein & Borun LLP

(57) ABSTRACT

A retractable instrument in accordance with the disclosure advantageously has a simple construction and fewer pieces or sub-assemblies than known retractable instruments. The retractable instrument includes a barrel that encloses a tool holder. The tool holder has an extension, and a tool extending from the distal end of the extension. A valve selectively covers the tool to protect the tool from environmental conditions. A biasing element is disposed between the valve and the tool holder, the biasing element biases the valve away from the tool holder. A movable closure assembly retains the valve on the extension and selectively allows the lid to open and close. The closure assembly includes a closure ring and a retention ring connected by one or more closure arms. The retention ring is disposed on the tool holder and the retention ring is prevented from sliding off of the tool holder by a retention stop.

15 Claims, 10 Drawing Sheets

U.S. PATENT DOCUMENTS

| | | | |
|---|---|---|---|
| 3,169,511 | A | 2/1965 | Spatz |
| 3,292,593 | A | 12/1966 | Furuya |
| 3,480,370 | A | 11/1969 | Koeln |
| 3,583,820 | A | 6/1971 | Koeln |
| 3,594,091 | A | 7/1971 | Bleuer |
| 3,617,138 | A | 11/1971 | Fukui et al. |
| 3,637,316 | A | 1/1972 | Bross et al. |
| 3,733,139 | A | 5/1973 | Neidhardt et al. |
| 3,813,176 | A | 5/1974 | Kamo |
| 3,895,632 | A | 7/1975 | Plowiecki et al. |
| 3,941,488 | A | 3/1976 | Maxwell |
| 3,944,371 | A | 3/1976 | Schenk |
| 3,945,734 | A | 3/1976 | Woodbridge |
| 3,955,893 | A | 5/1976 | Pulaski |
| 3,985,455 | A | 10/1976 | Wahlberg |
| 4,022,535 | A | 5/1977 | Ritter |
| 4,115,015 | A | 9/1978 | Torii et al. |
| 4,161,374 | A | 7/1979 | Koeln et al. |
| 4,177,814 | A | 12/1979 | Knepshield et al. |
| 4,218,154 | A | 8/1980 | Erfer |
| 4,221,490 | A | 9/1980 | Malm |
| 4,269,525 | A | 5/1981 | Melikian |
| 4,315,695 | A | 2/1982 | Alves dos Santos et al. |
| 4,318,340 | A | 3/1982 | Shenoha et al. |
| 4,416,392 | A | 11/1983 | Smith |
| 4,469,462 | A | 9/1984 | Hashimoto et al. |
| 4,479,732 | A | 10/1984 | Shimizu et al. |
| 4,533,271 | A | 8/1985 | Sansevero |
| 4,549,827 | A | 10/1985 | Mack |
| 4,560,297 | A | 12/1985 | Leem et al. |
| 4,575,271 | A | 3/1986 | Hashimoto et al. |
| 4,580,918 | A | 4/1986 | Baker et al. |
| 4,618,280 | A | 10/1986 | Kageyama et al. |
| 4,629,348 | A | 12/1986 | Hashimoto et al. |
| 4,667,828 | A | 5/1987 | Samuelson |
| 4,711,592 | A | 12/1987 | Gregory |
| 4,738,724 | A | 4/1988 | Wittwer et al. |
| 4,738,817 | A | 4/1988 | Wittwer et al. |
| 4,759,650 | A | 7/1988 | Granoff |
| 4,768,529 | A | 9/1988 | Mahruki et al. |
| 4,770,320 | A | 9/1988 | Miles et al. |
| 4,796,781 | A | 1/1989 | Windorski |
| 4,812,069 | A | 3/1989 | White et al. |
| 4,812,299 | A | 3/1989 | Wason |
| 4,815,881 | A | 3/1989 | Chern |
| 4,859,103 | A | 8/1989 | Wittek et al. |
| 4,863,796 | A | 9/1989 | Wason |
| 4,879,058 | A | 11/1989 | Wason |
| 4,879,323 | A | 11/1989 | Wason |
| 4,896,983 | A | 1/1990 | Im et al. |
| 4,902,657 | A | 2/1990 | Wason |
| 4,902,729 | A | 2/1990 | Wason |
| 4,904,101 | A | 2/1990 | Petterson |
| 4,907,825 | A | 3/1990 | Miles et al. |
| 4,911,570 | A | 3/1990 | Rhoades |
| 4,921,127 | A | 5/1990 | Windorski |
| 4,933,387 | A | 6/1990 | Wason |
| 4,937,078 | A | 6/1990 | Mezei et al. |
| 4,954,468 | A | 9/1990 | Wason |
| 4,957,233 | A | 9/1990 | Samuelson |
| 4,968,728 | A | 11/1990 | Wason |
| 4,974,980 | A | 12/1990 | Gueret et al. |
| 4,986,440 | A | 1/1991 | Windorski |
| 4,989,801 | A | 2/1991 | Thomas et al. |
| 4,993,590 | A | 2/1991 | Windorski |
| 5,015,111 | A | 5/1991 | Petterson |
| 5,022,773 | A | 6/1991 | Waldinger et al. |
| 5,022,775 | A | 6/1991 | Inoue et al. |
| 5,024,547 | A | 6/1991 | Mui et al. |
| 5,026,189 | A | 6/1991 | Keil |
| 5,048,990 | A | 9/1991 | Hashimoto et al. |
| 5,059,435 | A | 10/1991 | Sloan et al. |
| 5,072,686 | A | 12/1991 | Falco |
| 5,080,255 | A | 1/1992 | Windorski |
| 5,090,955 | A | 2/1992 | Simon |
| D324,542 | S | 3/1992 | Lin et al. |
| 5,092,701 | A | 3/1992 | Lai et al. |
| 5,158,205 | A | 10/1992 | Bodziak et al. |
| 5,165,570 | A | 11/1992 | Windorski et al. |
| 5,167,346 | A | 12/1992 | Bodziak |
| 5,174,814 | A | 12/1992 | Burwell et al. |
| 5,184,908 | A | 2/1993 | Yamamoto et al. |
| 5,207,523 | A | 5/1993 | Wittek |
| 5,336,006 | A | 8/1994 | Badr et al. |
| 5,342,135 | A | 8/1994 | Tucker |
| 5,342,136 | A | 8/1994 | Fukami et al. |
| 5,358,864 | A | 10/1994 | van den Broeck et al. |
| 5,372,580 | A | 12/1994 | Simon et al. |
| 5,411,168 | A | 5/1995 | Merten et al. |
| 5,420,615 | A | 5/1995 | Witz et al. |
| 5,426,456 | A | 6/1995 | Kuelzer et al. |
| 5,439,626 | A | 8/1995 | Bennett et al. |
| 5,454,655 | A | 10/1995 | Chiswell |
| 5,517,218 | A | 5/1996 | Lehna et al. |
| 5,547,301 | A | 8/1996 | Kageyama et al. |
| 5,547,468 | A | 8/1996 | Simon et al. |
| 5,553,956 | A | 9/1996 | Mitsuya et al. |
| 5,599,122 | A | 2/1997 | Yu |
| 5,604,036 | A | 2/1997 | Price et al. |
| 5,605,402 | A | 2/1997 | Uggetti et al. |
| 5,607,437 | A | 3/1997 | Simon et al. |
| 5,610,046 | A | 3/1997 | van Ooyen et al. |
| 5,643,660 | A | 7/1997 | Price et al. |
| 5,651,627 | A | 7/1997 | Dowzall et al. |
| 5,653,725 | A | 8/1997 | Simon et al. |
| 5,670,014 | A | 9/1997 | Mendelovich et al. |
| 5,672,021 | A | 9/1997 | Abber et al. |
| 5,676,481 | A | 10/1997 | Nicoll et al. |
| 5,697,518 | A | 12/1997 | Callahan, Jr. |
| 5,769,270 | A | 6/1998 | Fujisawa et al. |
| 5,813,787 | A | 9/1998 | Dowzall et al. |
| 5,823,697 | A | 10/1998 | Talbot et al. |
| D400,581 | S | 11/1998 | Hasegawa et al. |
| 5,829,904 | A | 11/1998 | Matsumoto et al. |
| 5,849,559 | A | 12/1998 | Van Der Wouw et al. |
| 5,855,442 | A | 1/1999 | Keller |
| 5,865,553 | A | 2/1999 | Sainte et al. |
| 5,871,294 | A | 2/1999 | Turner |
| 5,871,296 | A | 2/1999 | Furukawa et al. |
| 5,891,398 | A | 4/1999 | Lewis et al. |
| 5,899,618 | A | 5/1999 | Kobayashi et al. |
| 5,904,806 | A | 5/1999 | Mendelovich et al. |
| 5,906,446 | A | 5/1999 | McCulloch et al. |
| 5,915,867 | A | 6/1999 | Hashimoto et al. |
| 5,927,881 | A | 7/1999 | Yang |
| 5,927,882 | A | 7/1999 | Kageyama et al. |
| 5,927,883 | A | 7/1999 | Lebauer |
| 5,929,051 | A | 7/1999 | Ni et al. |
| 5,931,846 | A | 8/1999 | Simon et al. |
| 5,957,603 | A | 9/1999 | Bell |
| 5,961,703 | A | 10/1999 | Fraas et al. |
| 5,967,688 | A | 10/1999 | Hu et al. |
| D417,206 | S | 11/1999 | Hirota et al. |
| 6,019,535 | A | 2/2000 | Turner |
| 6,027,271 | A | 2/2000 | Barosso et al. |
| 6,033,141 | A | 3/2000 | Blaustein et al. |
| 6,048,121 | A | 4/2000 | Carver |
| 6,066,356 | A | 5/2000 | Van Der Wouw et al. |
| 6,089,776 | A | 7/2000 | Kaufmann et al. |
| 6,095,707 | A | 8/2000 | Kaufmann |
| 6,099,924 | A | 8/2000 | Nakamaki et al. |
| 6,106,179 | A | 8/2000 | Kuo |
| 6,120,204 | A | 9/2000 | Rigoni |
| 6,120,751 | A | 9/2000 | Unger |
| 6,135,660 | A | 10/2000 | Stevens et al. |
| 6,155,733 | A | 12/2000 | Holbrook et al. |
| 6,158,913 | A | 12/2000 | Dumler et al. |
| 6,170,318 | B1 | 1/2001 | Lewis |
| 6,210,768 | B1 | 4/2001 | Blok et al. |
| 6,213,661 | B1 | 4/2001 | Coon |
| 6,231,257 | B1 | 5/2001 | Stevens et al. |
| 6,244,744 | B1 | 6/2001 | Calvin |
| 6,244,774 | B1 | 6/2001 | Barosso et al. |
| 6,261,019 | B1 | 7/2001 | Furukawa et al. |
| D446,213 | S | 8/2001 | Chen et al. |
| 6,283,661 | B1 | 9/2001 | Connors |
| 6,306,598 | B1 | 10/2001 | Charych et al. |

6,347,898 B1 2/2002 Rhodes et al.
6,350,369 B1 2/2002 Lewis et al.
6,354,754 B1 3/2002 Pan
6,371,673 B1 4/2002 Gueret
D457,185 S 5/2002 Ham
6,398,178 B1 6/2002 Azola et al.
6,409,408 B2 6/2002 Koyama et al.
D460,484 S 7/2002 Bianco, Jr.
D460,982 S 7/2002 Bianco, Jr.
6,416,242 B1 7/2002 Kaufmann et al.
6,417,121 B1 7/2002 Newkirk et al.
6,417,122 B1 7/2002 Newkirk et al.
6,420,285 B1 7/2002 Newkirk et al.
6,433,012 B1 8/2002 Tuse et al.
6,468,759 B1 10/2002 Charych
6,478,495 B2 11/2002 Ami et al.
6,482,517 B1 11/2002 Anderson
6,497,524 B1 12/2002 Kim
6,505,984 B2 1/2003 Smith et al.
D471,233 S 3/2003 Geiselhart et al.
D472,578 S 4/2003 Plantz et al.
6,540,422 B2 4/2003 Torii et al.
6,554,516 B1 4/2003 Christopher
6,554,517 B2 4/2003 Ahmed
6,561,713 B2 5/2003 Sukhna et al.
6,565,275 B2 5/2003 Brand et al.
6,565,763 B1 5/2003 Asakawa et al.
6,588,958 B1 7/2003 Seidler
6,605,344 B1 8/2003 Ohba et al.
6,607,325 B2 8/2003 Hori et al.
6,631,333 B1 10/2003 Lewis et al.
6,638,621 B2 10/2003 Anderson
6,644,880 B2 11/2003 Duez et al.
6,648,539 B2 11/2003 Dai et al.
6,656,319 B1 12/2003 Boyd et al.
D487,113 S 2/2004 Kent
D489,087 S 4/2004 Kent
6,719,472 B2 4/2004 Windorski et al.
6,723,394 B1 4/2004 Sirringhaus et al.
6,752,557 B1 6/2004 Hsieh et al.
6,755,584 B2 6/2004 O'Brien et al.
D497,180 S 10/2004 Cetera
D497,387 S 10/2004 Cetera
D501,509 S 2/2005 Lecce et al.
6,866,436 B2 3/2005 Kanari et al.
6,927,256 B2 8/2005 Stevens et al.
6,964,534 B2 11/2005 Brand et al.
6,967,102 B1 11/2005 Anderson et al.
6,974,697 B2 12/2005 Comer et al.
6,977,244 B2 12/2005 Tormo et al.
6,979,456 B1 12/2005 Parikh et al.
6,979,558 B2 12/2005 Harris, Jr. et al.
6,979,559 B2 12/2005 Harris, Jr. et al.
6,981,812 B1 * 1/2006 Hsieh ..... 401/108
6,989,007 B2 1/2006 Shadduck
6,989,195 B2 1/2006 Anderson
6,991,514 B1 1/2006 Meloni et al.
7,004,945 B2 2/2006 Boyd et al.
7,008,633 B2 3/2006 Yang et al.
7,018,838 B2 3/2006 Murphy et al.
7,022,683 B1 4/2006 Ni et al.
7,037,015 B1 5/2006 Witz et al.
7,037,657 B2 5/2006 Le et al.
7,048,963 B2 5/2006 Braithwaite et al.
7,059,796 B2 6/2006 Lewis, Jr. et al.
7,060,754 B2 6/2006 Stevens et al.
7,101,102 B2 9/2006 Sawa et al.
7,220,073 B2 5/2007 Yoon et al.
7,322,766 B2 1/2008 Erlebacher et al.
7,329,062 B2 2/2008 Brand et al.
7,331,730 B2 * 2/2008 Fukui et al. ..... 401/108
7,341,388 B2 3/2008 Carroll
7,350,996 B2 4/2008 Bielecki et al.
7,465,112 B2 12/2008 Qiu et al.
7,488,130 B2 2/2009 Dylkiewicz et al.
2002/0010510 A1 1/2002 Silvestrini
2002/0029084 A1 3/2002 Paul et al.
2002/0081139 A1 6/2002 Legg
2002/0081232 A1 6/2002 Lewis et al.
2002/0131807 A1 9/2002 Ami et al.
2002/0142477 A1 10/2002 Lewis et al.
2002/0159817 A1 10/2002 Brand et al.
2002/0159818 A1 10/2002 Smith et al.
2002/0172544 A1 11/2002 Dai
2002/0192007 A1 12/2002 Lee
2003/0000958 A1 1/2003 Windorski et al.
2003/0068191 A1 4/2003 Hori
2003/0108377 A1 6/2003 Duez et al.
2003/0108743 A1 6/2003 Anderson
2003/0138283 A1 7/2003 O'Brien et al.
2003/0195300 A1 10/2003 Stevens et al.
2003/0210945 A1 11/2003 Noguchi
2003/0210947 A1 11/2003 Calendrille et al.
2003/0211130 A1 11/2003 Sanders et al.
2003/0215281 A1 11/2003 Sexton et al.
2003/0222048 A1 12/2003 Asakawa et al.
2004/0028875 A1 2/2004 Van Rijn et al.
2004/0037609 A1 2/2004 Kageyama
2004/0050816 A1 3/2004 Asakawa et al.
2004/0062879 A1 4/2004 Bowman et al.
2004/0201117 A1 10/2004 Anderson
2004/0213627 A1 10/2004 Marschand et al.
2004/0234326 A1 11/2004 Erlebacher et al.
2004/0265035 A1 12/2004 Brand et al.
2004/0265039 A1 12/2004 Buck
2005/0004578 A1 1/2005 Lambrecht et al.
2005/0019112 A1 1/2005 Erickson et al.
2005/0043470 A1 2/2005 Stevens et al.
2005/0047844 A1 3/2005 Lammers et al.
2005/0058497 A1 3/2005 Marschand
2005/0074268 A1 4/2005 Beil
2005/0079003 A1 4/2005 Buck et al.
2005/0084320 A1 4/2005 Carroll
2005/0084321 A1 4/2005 Carroll
2005/0089656 A1 4/2005 Shiina
2005/0115690 A1 6/2005 Bohlig
2005/0191112 A1 9/2005 Yoon
2005/0196580 A1 9/2005 Provost et al.
2005/0196583 A1 9/2005 Provost et al.
2005/0208259 A1 9/2005 Provost et al.
2005/0217092 A1 10/2005 Barker et al.
2005/0221271 A1 10/2005 Murphy et al.
2005/0246023 A1 11/2005 Yeung
2005/0250181 A1 11/2005 Schroder Glad et al.
2005/0256253 A1 11/2005 Parker et al.
2005/0265774 A1 12/2005 Albisetti
2005/0271451 A1 12/2005 Brand et al.
2006/0002755 A1 1/2006 Sawa
2006/0002852 A1 1/2006 Saltzman et al.
2006/0002971 A1 1/2006 Saltzman et al.
2006/0004193 A1 1/2006 Muller et al.
2006/0004314 A1 1/2006 McCarthy et al.
2006/0019339 A1 1/2006 Lauth et al.
2006/0036269 A1 2/2006 Schachar et al.
2006/0051274 A1 3/2006 Wright et al.
2006/0051451 A1 3/2006 Hutchinson et al.
2006/0051735 A1 3/2006 Fuhr et al.
2006/0058383 A1 3/2006 Huang et al.
2006/0062780 A1 3/2006 Zocher et al.
2006/0063882 A1 3/2006 Velev et al.
2006/0065992 A1 3/2006 Hutchinson et al.
2006/0069230 A1 3/2006 Papisov
2006/0073159 A1 4/2006 Vonderheide et al.
2006/0073294 A1 4/2006 Hutchinson et al.
2006/0073298 A1 4/2006 Hutchinson et al.
2006/0073333 A1 4/2006 Anderson
2006/0084034 A1 4/2006 Hochman
2006/0088897 A1 4/2006 Lim et al.
2006/0095066 A1 5/2006 Chang et al.
2006/0099244 A1 5/2006 Guilford
2006/0106408 A1 5/2006 Schachar et al.
2006/0106409 A1 5/2006 Schachar et al.
2006/0110439 A1 5/2006 Tobia et al.
2006/0115462 A1 6/2006 Subbotin et al.
2006/0116712 A1 6/2006 Sepetka et al.
2006/0116713 A1 6/2006 Sepetka et al.
2006/0121608 A1 6/2006 Comer et al.
2006/0216103 A1 9/2006 Bielecki et al.

| | | | |
|---|---|---|---|
| 2007/0172300 | A1 | 7/2007 | Wlodarczyk |
| 2008/0131188 | A1 | 6/2008 | Breuer et al. |
| 2008/0138139 | A1 | 6/2008 | Kageyama |
| 2008/0175648 | A1 | 7/2008 | Hayes et al. |
| 2008/0193194 | A1 | 8/2008 | Yoon |
| 2008/0298878 | A1 | 12/2008 | Hui |

FOREIGN PATENT DOCUMENTS

| | | |
|---|---|---|
| DE | 1 259 732 | 1/1968 |
| DE | 26 49 230 | 4/1978 |
| DE | 33 41 759 | 5/1985 |
| DE | 34 38 074 | 4/1986 |
| DE | 88 05 298 | 8/1989 |
| DE | 88 06 917 | 11/1989 |
| DE | 89 00 030 U | 5/1990 |
| DE | 295 10 975 | 9/1995 |
| DE | 33 41 759 | 11/1997 |
| DE | 297 09 080 | 10/1998 |
| DE | 100 30 440 | 1/2002 |
| DE | 103 26 926 | 1/2005 |
| EP | 0 150 557 | 8/1985 |
| EP | 0 267 557 | 5/1988 |
| EP | 0 316 007 | 5/1989 |
| EP | 0 354 823 | 2/1990 |
| EP | 0 400 272 | 12/1990 |
| EP | 0 416 181 | 3/1991 |
| EP | 0 469 465 | 2/1992 |
| EP | 0 545 917 | 6/1993 |
| EP | 0 586 792 | 3/1994 |
| EP | 0 667 818 | 8/1995 |
| EP | 0 703 096 | 3/1996 |
| EP | 0 711 673 | 5/1996 |
| EP | 0 822 098 | 2/1998 |
| EP | 0 899 128 | 3/1999 |
| EP | 1 050 417 | 11/2000 |
| EP | 1 354 722 | 10/2003 |
| EP | 1 600 078 | 11/2005 |
| EP | 1955869 | 8/2008 |
| FR | 1 424 492 | 1/1966 |
| FR | 2 220 353 | 10/1974 |
| FR | 2907371 | 4/2008 |
| GB | 243110 | 11/1925 |
| GB | 937632 | 9/1963 |
| GB | 2 106 044 | 4/1983 |
| GB | 2 325 649 | 12/1998 |
| JP | 58-009788 | 1/1983 |
| JP | 58-153081 | 9/1983 |
| JP | 60-119588 | 6/1985 |
| JP | 1-280596 | 11/1989 |
| JP | 1-281999 | 11/1989 |
| JP | 2-041992 | 3/1990 |
| JP | 2-108086 | 4/1990 |
| JP | 2-283499 | 11/1990 |
| JP | 4-043345 | 2/1992 |
| JP | 4-316899 | 11/1992 |
| JP | 6-035232 | 2/1994 |
| JP | 6-216585 | 8/1994 |
| JP | 7-242094 | 9/1995 |
| JP | 7-290883 | 11/1995 |
| JP | 7-329486 | 12/1995 |
| JP | 8-072470 | 3/1996 |
| JP | 8-108676 | 4/1996 |
| JP | 8-216585 | 8/1996 |
| JP | 8-258480 | 10/1996 |
| JP | 8-282174 | 10/1996 |
| JP | 8-282175 | 10/1996 |
| JP | 9-131994 | 5/1997 |
| JP | 10-100579 | 4/1998 |
| JP | 10-114188 | 5/1998 |
| JP | 11-139081 | 5/1999 |
| JP | 2000-025386 | 1/2000 |
| JP | 2003-128971 | 5/2003 |
| JP | 2003312185 | 11/2003 |
| JP | 2003312186 | 11/2003 |
| JP | 2003312188 | 11/2003 |
| KP | 2003-056790 | 7/2003 |
| KP | 2003-060260 | 7/2003 |
| KP | 2003061516 | 7/2003 |
| WO | WO-90/00118 | 1/1990 |
| WO | WO-93/12175 | 6/1993 |
| WO | WO-93/17879 | 9/1993 |
| WO | WO-94/11204 | 5/1994 |
| WO | WO-94/11205 | 5/1994 |
| WO | WO-94/25293 | 11/1994 |
| WO | WO-95/07191 | 3/1995 |
| WO | WO-96/39054 | 12/1996 |
| WO | WO-98/06450 | 2/1998 |
| WO | WO-99/11471 | 3/1999 |
| WO | WO-01/28696 | 4/2001 |
| WO | WO-01/64453 | 9/2001 |
| WO | WO-02/06437 | 1/2002 |
| WO | WO-02/13173 | 2/2002 |
| WO | WO-02/064379 | 8/2002 |
| WO | WO-03/002357 | 1/2003 |
| WO | WO-03/068530 | 8/2003 |
| WO | WO-2005/009755 | 2/2005 |
| WO | WO-2007/097602 | 8/2007 |
| WO | WO-2007/126253 | 11/2007 |
| WO | WO-2008/029993 | 3/2008 |

OTHER PUBLICATIONS

International Search Report for International Patent Application No. PCT/US04/008490, dated Jan. 7, 2005.

Invitation to Pay Additional Fees corresponding to International Patent Application Serial No. PCT/US2005/001831, European Patent Office, dated Mar. 7, 2006.

Photograph A, Boone Marker, capped. Believed to be available as early as Jan. 30, 2009.

Photograph B, Boone Marker, uncapped. Believed to be available as early as Jan. 30, 2009.

Photograph C, Colorific Retractable Marker, retracted. Believed to be available as early as Jan. 30, 2009.

Photograph D, Colorific Retractable Marker, extended. Believed to be available as early as Jan. 30, 2009.

Photograph E, Marks-A-Lot Retractable Marker, retracted. Believed to be available as early as Jan. 30, 2009.

Photograph F, Marks-A-Lot Retractable Marker, extended. Believed to be available as early as Jan. 30, 2009.

Photograph G, Sharpie RT Marker, retracted. Believed to be available as early as Jan. 30, 2009.

Photograph H, Sharpie RT Marker, extended. Believed to be available as early as Jan. 30, 2009.

Photograph I, Tokai Retractable Marker, retracted. Believed to be available as early as Jan. 30, 2009.

Photograph J, Tokai Retractable Marker, extended. Believed to be available as early as Jan. 30, 2009.

Photograph K, Pentel Pen NX5. Believed to be available as early as Jan. 30, 2009.

Photograph L, Stabilo Swing Click. Believed to be available as early as Jan. 30, 2009.

Written Opinion for International Patent Application No. PCT/US04/008490, dated Jan. 7, 2005.

European Search Report for Application No. 09008302.3-2304/2189296, dated Oct. 27, 2011.

* cited by examiner

RETRACTABLE INSTRUMENT HAVING A TWO STAGE PROTRACTION/RETRACTION SEQUENCE

BACKGROUND

1. Field of the Disclosure

The disclosure generally relates to retractable instruments having a two stage protraction/retraction sequence and specifically relates to cap-less writing instruments having two stage protraction/retraction sequence.

2. Related Technology

Markers and other writing instruments having volatile inks generally prevent evaporation of said inks by sealing a nib, or other writing point, of the writing instrument from the environment. Traditionally, such markers and writing instruments utilized a removable cap for covering and sealing the writing point. Such arrangements are cumbersome to use, however, as two hands are needed to remove or attach the cap. Additionally, the cap was prone to loss when removed from the writing instrument.

To solve the cap problem, "cap-less" writing instruments have been developed. One example of a cap-less writing instruments is disclosed in U.S. Pat. No. 5,048,990, which is hereby incorporated by reference. The cap-less writing instrument includes a writing member having a writing point. The writing member is accommodated in a seal cylinder that is disposed inside a writing instrument body. A seal cover for closing an end opening of the seal cylinder is disposed on the seal cylinder near the front end of the seal cylinder. A writing member moving mechanism moves the writing member forwardly and locks the writing member at a writing position with the writing point protruding through the front of the writing instrument body. The moving mechanism includes a thread-like member (e.g., monofilament line) that connects the writing member to the seal cover so that after the writing member is retracted, the seal cover is pulled backwardly so as to be brought into contact with the seal cylinder, thus preventing the writing point from drying out when the writing point is in the retracted position. Prior art cap-less writing instruments, such as the writing instrument disclosed in U.S. Pat. No. 5,048,990, are difficult and expensive to assemble and such cap-less writing instruments rely on the writing point to open the seal cover during extension of the writing point. Eventually ink builds up on an inner surface of the seal cover and this buildup of ink can cause a breach in the seal between the seal cylinder and the seal cover, thus leading to premature drying of the writing point. Moreover, the monofilament line was subject to fatigue failure from repeated uses, and must be positioned over the seal cover by hand.

In order to overcome some of the aforementioned problems with previous cap-less writing instruments, cap-less writing instruments were developed that replaced the monofilament closure device with a cover holder having an upper ring and a lower ring connected by a plurality of supports, as shown in U.S. Pat. No. 6,981,812, which is hereby incorporated by reference. The supports were of a rigid construction and the cover holder was disposed on a supporting device. A valve and spring were disposed within the cover holder forming a sub-assembly consisting of the valve, spring, cover holder and the supporting device. The sub-assembly was disposed on a reservoir holder. While this construction solved some of the problems in prior art cap-less writing instruments, the device shown in U.S. Pat. No. 6,981,812 remained relatively complicated and expensive to manufacture because of its many parts and sub-assemblies. Further, because the supporting device is movably disposed on the reservoir holder, manufacturing reproducibility was difficult to optimize because the cover holder/valve/spring/supporting device sub-assembly can become dislodged/damaged during the assembly process. Adequate slack in the internal assembly can also potentially allow the reservoir holder to move back through the valve far enough to breach the seal during the lifetime of the device. Thus, the writing instrument is subject to failure due to possible separation of the supporting device from the reservoir holder.

SUMMARY OF THE DISCLOSURE

A retractable instrument in accordance with the disclosure is advantageously of simple construction and thus includes fewer pieces or sub-assemblies than known retractable instruments. The retractable instrument includes a barrel that encloses a tool holder. The tool holder has an extension extending from one end, and a tool extending from the distal end of the extension. A valve selectively covers the tool to protect the tool from environmental conditions. A biasing element is disposed between the valve and the tool holder, the biasing element biases the valve away from the tool holder. A movable closure assembly retains the valve on the extension and selectively allows the lid to open and close. The closure assembly includes a closure ring and a retention ring connected by one or more closure arms. The retention ring is disposed on the tool holder and the retention ring is prevented from sliding off of the tool holder by a retention stop.

In another aspect, a cap-less retractable writing instrument in accordance with the disclosure is advantageously of simple construction and thus includes fewer pieces or sub-assemblies than known cap-less retractable writing instruments. The cap-less retractable writing instrument includes a barrel that encloses a reservoir holder. The reservoir holder has an extension extending from one end, and a writing nib extending from the distal end of the extension. A valve selectively seals the writing nib from the environment to prevent premature drying of the writing nib. A biasing element is disposed between the valve and the reservoir holder, the biasing element biases the valve away from the reservoir holder. A movable closure assembly retains the valve on the extension and selectively allows the lid to open and close. The closure assembly includes a closure ring and a retention ring connected by one or more closure arms. The retention ring is disposed on the reservoir holder and the retention ring is prevented from sliding off of the reservoir holder by a retention stop.

The disclosed cap-less retractable tool integrates support of the closure assembly into the tool holder, therefore the tool cannot come out of the valve during or after assembly. Integrating the closure assembly support into the tool holder also reduces tolerance requirements during assembly.

BRIEF DESCRIPTION OF THE DRAWINGS

Exemplary aspects and features of an instrument constructed in accordance with the disclosure are described and explained in greater detail below with the aid of the drawing figures in which.

DETAILED DESCRIPTION

Figure 1:
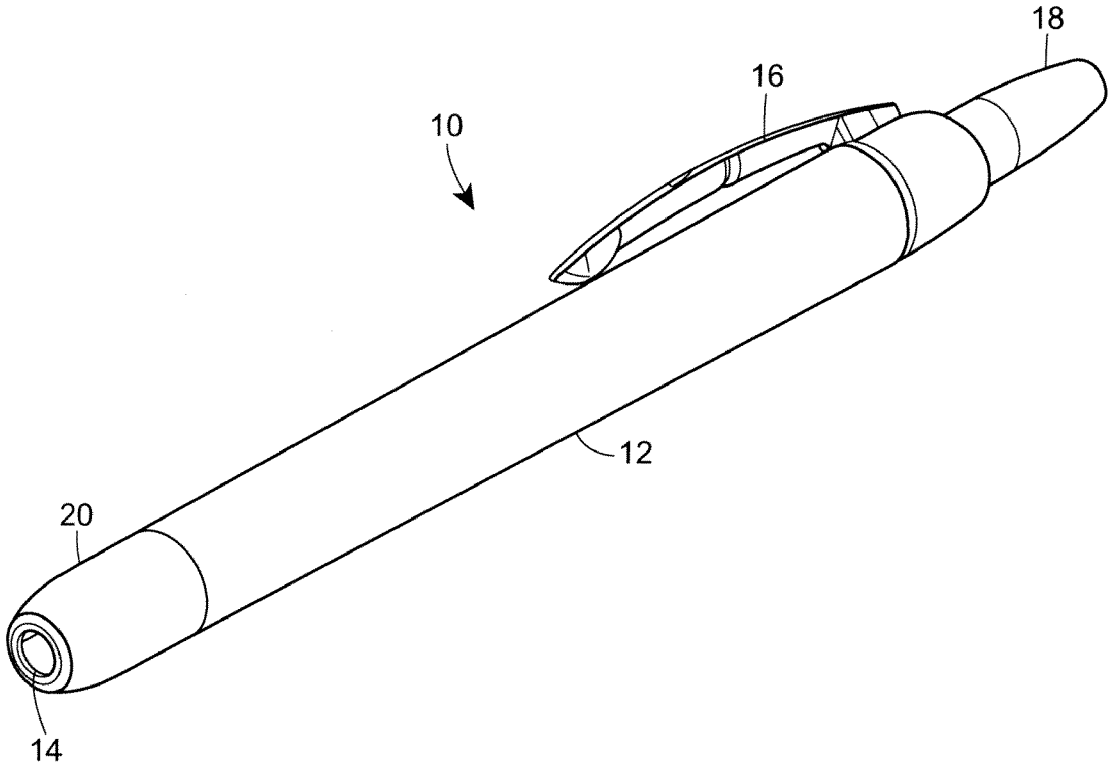
FIG. 1 is a perspective view of a cap-less retractable writing instrument constructed in accordance with the teachings of the disclosure.
Figure 2:
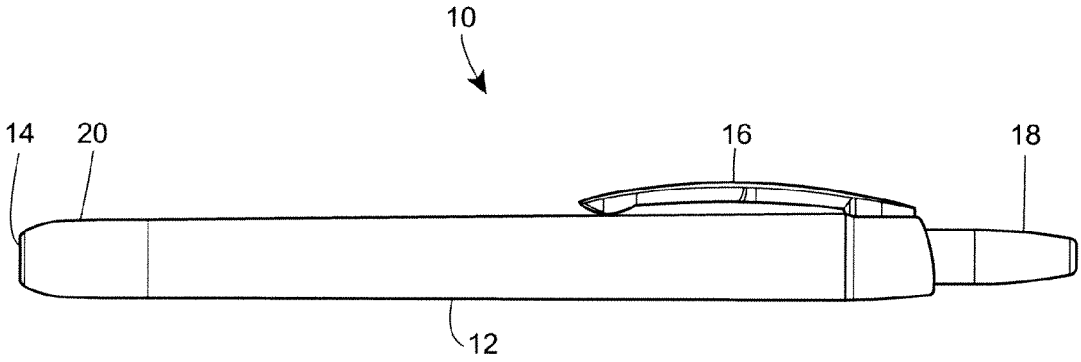
FIG. 2 is a side elevational view of the cap-less retractable writing instrument of FIG. 1.

A cap-less retractable writing instrument in accordance with the disclosure is advantageously of simple construction and thus includes fewer pieces or sub-assemblies than known cap-less retractable writing instruments. Moreover, the cap-less retractable writing instrument in accordance with the disclosure provides more reproducible manufacturability and fewer points of failure than prior art cap-less retractable writing instruments. The cap-less retractable writing instrument 10 shown in FIGS. 1 and 2 includes a barrel 12 having an opening 14 at one end. The opening 14 allows a nib 24, 124 (See FIGS. 5, 8, and 10) to extend outside the barrel 12 into a fully protracted (or extended) position in which the nib 24 is positioned for transferring ink to a substrate (not shown). The cap-less retractable writing instrument 10 may optionally include a clip 16 for securing the cap-less retractable writing instrument 10 to an object, such as a shirt pocket. The cap-less retractable writing instrument 10 also may include an actuator button 18 that may be pushed by a user to protract and/or retract the nib 24. The barrel 12 may include a tapered nose section 20.

Figure 3:
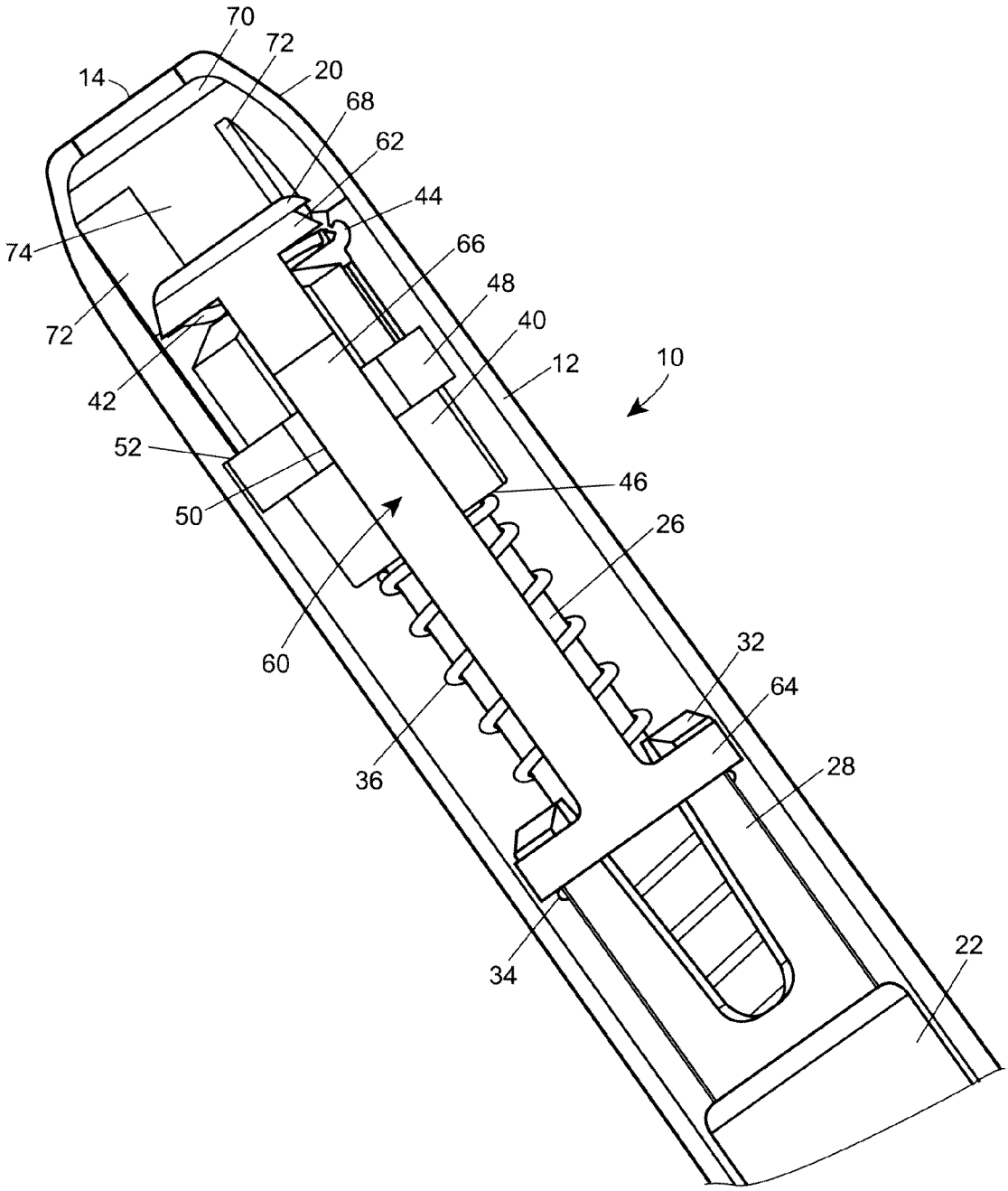
FIG. 3 is a cutaway view of a front portion of a cap-less retractable writing instrument constructed in accordance with the teachings of the disclosure, a nib of the cap-less retractable writing instrument being in a fully retracted position.
Figure 4:
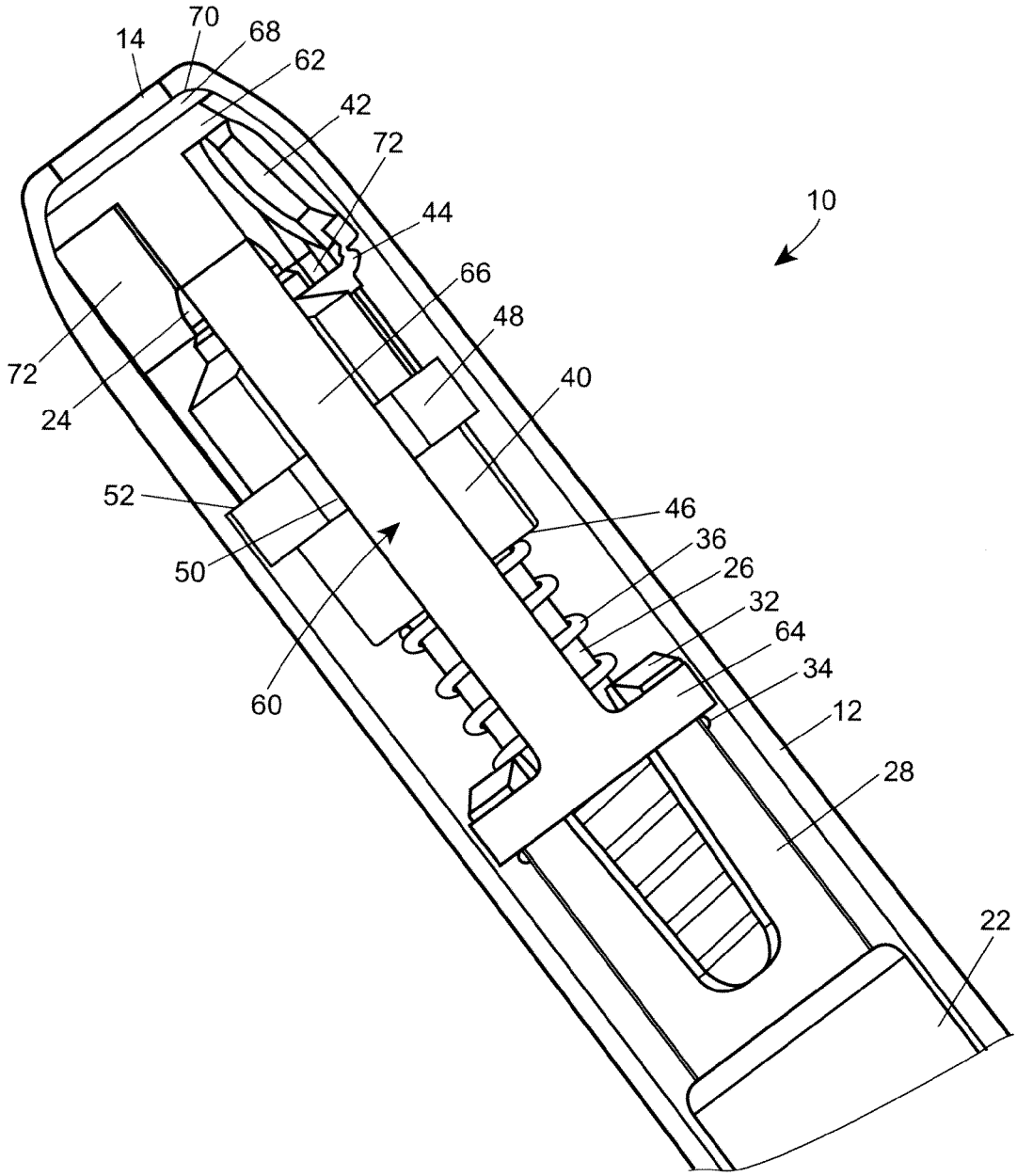
FIG. 4 is a cutaway view of a front portion of the cap-less retractable writing instrument of FIG. 3, a nib of the cap-less retractable writing instrument being in an intermediate position between the fully retracted position and a fully extended position.
Figure 5:
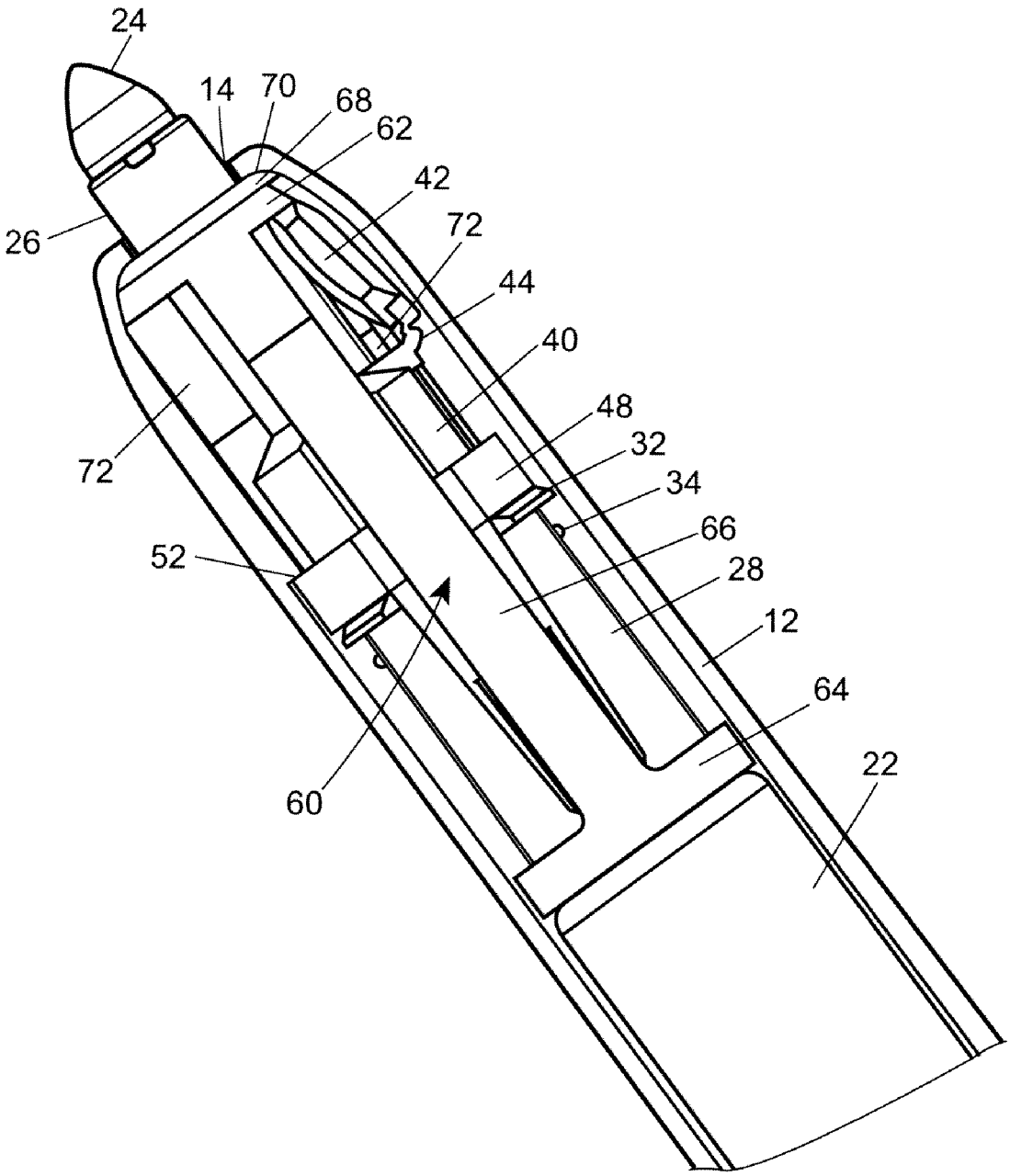
FIG. 5 is a cutaway view of a front portion of the cap-less retractable writing instrument of FIG. 3, a nib of the cap-less retractable writing instrument being in the fully extended position.

As shown in FIGS. 3-5, the barrel 12 contains a reservoir holder 22 that holds ink (or other fluid) for delivery to a nib 24. The reservoir holder 22 includes an extension 26 of reduced diameter extending from one end of the reservoir holder 22. The reservoir holder 22 also includes one or more integral retention arms 28 extending from the same end of the reservoir holder 22 as the extension 26. The one or more retention arms 28 extend substantially parallel to the extension 26 but are spaced apart therefrom, thereby forming a gap between the one or more retention arms 28 and the extension 26. The one or more retention arms 28 may be flexible in an axial direction towards and away from the extension 26 to ease assembly of the cap-less retractable writing instrument 10. The one or more retention arms 28 may include a retention stop 32 and a protrusion 34 between the retention stop 32 and the reservoir holder 22. A biasing member 36 that provides protraction/retraction force is disposed on the extension 26 between a valve 40 and the reservoir holder 22.

Disposed on a distal end of the extension 26 is the valve 40 including a lid 42 hingedly attached to an open end of the valve 40. The valve 40 substantially surrounds the distal end of the extension 26 and the nib 24 when the nib 24 is in a fully retracted position. The valve 40 and the lid 42 cooperate to seal the nib 24 from the environment to prevent evaporation of volatile ink components (e.g., solvents and the like) and premature drying of the nib 24. The lid 42 may be attached to the valve 40 by any known attachment means that allows the lid to be selectively moved away from the open end of the valve 40. For example, the lid 42 may be attached to the valve 40 with a living hinge 44 and the living hinge 44 may optionally bias the lid 42 to an open position. In another aspect, the lid 42 may include a beveled, spherical or other shaped top surface (FIG. 6), for guiding and aligning the lid 42 with a portion of a closure assembly 60, as explained in further detail below, when the nib 24 is in the fully retracted position. The biasing member 36 seats against a bottom surface 46 of the valve 40 to bias the valve 40 away from the reservoir holder 22. The bottom surface 46 may optionally be recessed forming an annular reception space (not shown) for one end of the biasing member 36 to retain the biasing member 36 in a seated position. The valve 40 also may include one or more shoulders 48 for engaging a ledge 52 on an inner surface of the barrel 12. The valve 40 is held in a fixed position relative to the barrel 12 by the biasing member 36 forcing the one or more shoulders 48 against the ledge 52.

The closure assembly 60 includes a closure ring 62 at one end and a retention ring 64 at another end. The closure ring 62 and retention ring 64 are spaced apart from one another and connected by at least one closure arm 66. While in the illustrated embodiments two retention arms are shown, a single retention arm could also be used. The retention ring 64 secures the closure assembly 60 to the reservoir holder 22. The retention ring 64 is longitudinally movable along the one or more retention arms 28 between the retention stop 32 and the reservoir holder 22. When the nib 24 is in the retracted position (FIG. 3), the retention ring 64 is generally located between the protrusion 34 and the retention stop 32. An interaction between the retention ring 64 and the protrusion 34 produces a frictional force which may be overcome during protraction of the nib 24, as will be discussed further hereinafter. The protrusion 34 separates protraction/retraction into two stages that will be discussed further hereinafter. When the nib 24 is in the fully extended protracted (or writing) position (FIG. 5), the retention ring 64 is generally located between the reservoir holder 22 and the protrusion 34.

A portion of the closure arms 66 may be disposed at least partially in a notch(s) 50 located in a side surface of the valve 40. The notch 50 may accommodate at least a portion of a thickness of the closure arm 66 so that the barrel 12 does not need to be significantly enlarged to accommodate the closure assembly 60. The closure ring 62 may include a beveled outer surface 68 and a corresponding angled, spherical or other shaped inner surface (not shown). The beveled outer surface 68 seats against a corresponding tapered inner surface 70 of the nose section 20 when the nib 24 is in the fully extended position (FIG. 5) or in an intermediate position (FIG. 4). The tapered inner surface 70 and the beveled outer surface 68 cooperate to align and position the closure ring 62 against the opening 14 so that the nib 24 extends through the opening 14 in a proper position. Likewise, the top surface of the lid 42 is guided into the closed position by the angled, spherical or other shaped inner surface of the closure ring 62. These features can therefore be included to increase the reproducibility of the sealing mechanism and to remove a potential failure point between a movable (or non integral) supporting device.

The barrel 12 may also include one or more ribs or guides 72 disposed on an inner surface thereof. The one or more guides 72 may form a channel 74 along an inner surface of the barrel 12. The channel 74 may be sized to receive a portion of the closure arm 66 and/or a portion of the valve 40 to guide the closure assembly 60 and/or valve 40 longitudinally during extension and retraction of the nib 24.

FIGS. 3-5 depict the cap-less retractable writing instrument in a fully retracted (e.g., closed) position (FIG. 3), an intermediate position (FIG. 4), and a fully protracted (e.g., open) position (FIG. 5), respectively. The fully protracted position of FIG. 5 is the normal writing position and the fully retraced position of FIG. 4 is the normal secured (or storage) position. The protraction sequence begins with FIG. 3 and ends with FIG. 5 (the retraction sequence is the reverse). Beginning with FIG. 3, the valve 40 and lid 42 are in a closed and sealed position over the nib 24, wherein the closure ring 62 maintains positive pressure on the lid 42. As the valve 40 is forced forward (i.e., towards the opening 14) by the biasing member 36, the closure ring 62 controls forward movement of the valve 40 and lid 42 thereby retaining positive sealing contact between the lid 42 and the valve 40 until the opening sequence is started. In the fully retraced position, the closure ring 62 maintains position by the closure arms 66, which are attached to the retention ring 64. The retention ring 64, in turn, is prevented from forward movement by the retention stops 32 on the retention arms 28.

When a user pushes the actuator button 18, the reservoir holder 22 begins to move forward, towards the opening 14 (FIG. 4). FIG. 4 essentially depicts the end of the first opening stage and the beginning of the second opening stage. Movement of the valve 40 is controlled by the interaction between the ledge 52 and shoulder 48, as previously described. Because of the movement of the reservoir holder 22, the closure assembly 60, the retention arms 28, and the extension 26 also move forward towards the opening 14. The retention ring 64 is pushed forward, towards the reservoir holder 22, by the frictional force created by the interaction between protrusion 34 and the retention ring 64, as previously described. Thus, a first stage in the opening sequence, as shown in FIG. 4, includes relative movement of the closure assembly 60, the extension 26, and the reservoir holder 22 with respect to the valve 40 and the barrel 12. As the closure ring 62 begins to move away from the valve 40 such that it is no longer in positive sealing contact with the lid 42, the closure ring allows the lid 42 (normally biased to an open position by the living hinge 44) to begin to move away from the valve 40. In an alternative embodiment, the lid 42 may be forced or pushed open by the closure assembly 60 as will be further discussed with reference to FIG. 6.

In the first stage of the opening sequence (i.e., before the frictional force produced by the interaction between the protrusion 34 and the retention ring 64 is overcome), the lid 42 opens before the nib 24 contacts the lid 42. As a result, impact damage to the nib 24 and ink buildup on an inner surface of the lid 42 are prevented. Thus, the disclosed cap-less retractable writing instrument 10 reduces valve 40 sealing problems caused by the buildup of ink on the inner surface of the lid 42. Eventually, the closure ring 62 is prevented from further forward movement by contact with the inner tapered surface 70 of the nose section 20.

During the second opening stage, the closure assembly 60 is prevented from further forward movement by contact with the nose section 20. When the beveled surface 68 of the closure ring 62 seats against the tapered surface 70 of the nose section 20, the closure assembly 60 becomes fixed with respect to the barrel 12 and is prevented from further forward movement. At this point, the lid 42 is in the fully open position shown in FIG. 4. Eventually, enough force is generated to overcome the frictional force produced by interaction between the retention ring 64 and the protrusions 34. After the frictional force is overcome, the protrusions 34 slide through the retention ring 64. As a result, the reservoir holder 22, extension 26, and retention arms 28 continue to move forward relative to the valve 40, the barrel 12, and the closure assembly 60. The retention ring 64 stops moving forward due to the closure ring 62 contacting the nose section 20 while the nib 24 and the reservoir holder 22 continue to move forward. Eventually the retention ring 64 reaches a point where the retention ring 64 is seated on the reservoir holder 22. Thus, in the fully protracted position, the retention ring 64 is disposed between the reservoir holder 22 and the protrusions 34. As the reservoir holder 22 continues to move relative to the barrel 12 and the closure assembly 60, the nib 24 eventually extends out of the opening 14 and into the fully protracted writing position (FIG. 5).

Figure 6:
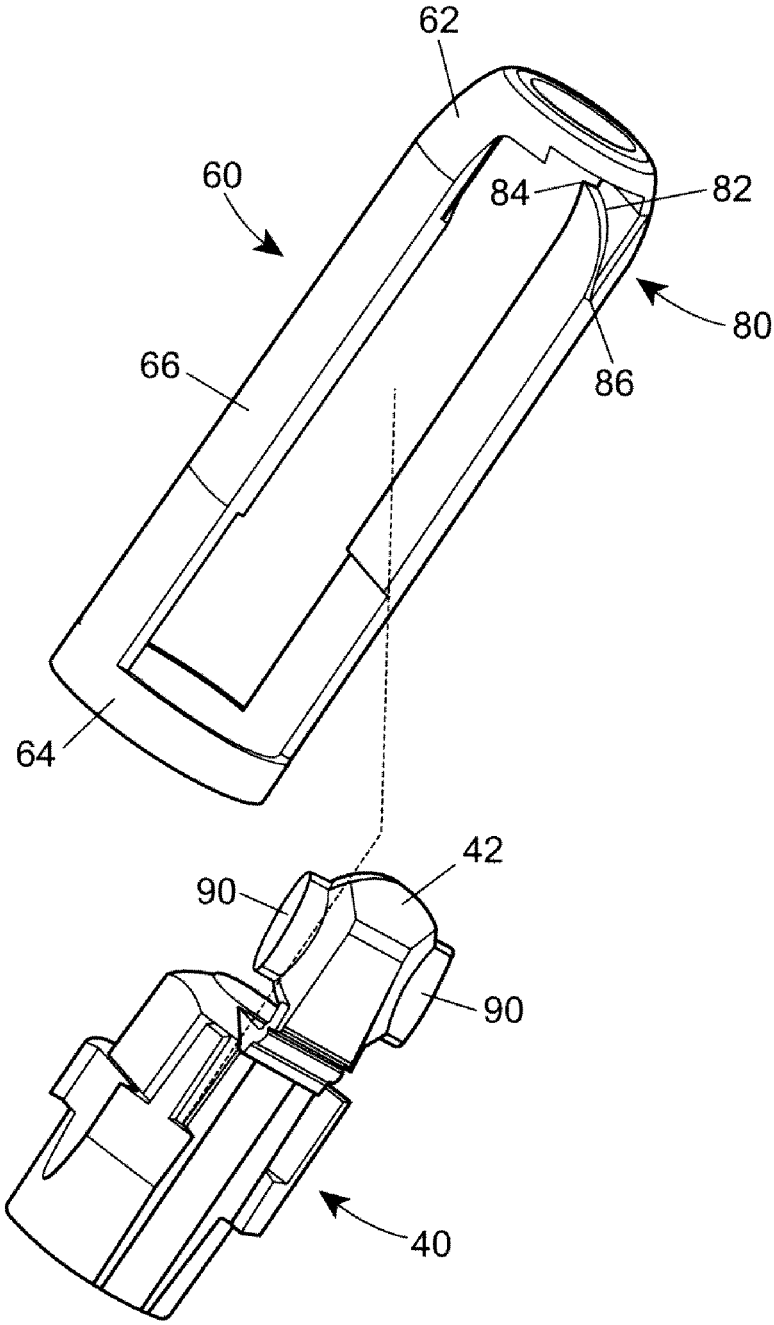
FIG. 6 is an exploded view of an additional valve and closure assembly in accordance with the disclosure.

FIG. 6 shows an optional cam element 80 located on an inner surface of the closure assembly 60. The cam element 80 includes one or more cam surfaces 82, which may be curved. The curvature of the cam surfaces 82 may be based on the speed at which the lid 42 is desired to open. For example, a gentle curvature at a beginning 84 of the cam surface 82 results in a more gradual initial opening of the lid 42, while a more steeply sloped curvature results in a faster initial opening of the lid 42. Likewise, a more gradual curvature at an end 86 of the cam surface 82 results in a more gradual initial closing of the lid 42, while a more steeply sloped curvature results in a faster initial closing of the lid 42. The lid 42 in the embodiment shown in FIG. 6 includes one or more ears 90. The one or more ears 90 are positioned within and move along the cam surfaces 82 during the opening sequence. In the embodiment of FIG. 6, the ears 90 remain in contact with the cam surfaces 82 throughout the opening sequence. For example, in the fully retracted position, the ears 90 rest on the cam surfaces 82 while the top of the lid 42 is in contact with the closure ring 62. However, the ears 90 may optionally fall out of contact with the cam surfaces 82 in the fully retracted position or the fully protracted position. As the closure assembly 60 moves forward, the cam surfaces 82 push or force the ears 90 (and thus the lid 42) in a direction along the cam surfaces 82. The interaction between the ears 90 and the cam surfaces 82 opens the lid 42 in a predictable and controllable manner.

FIGS. 7-10 depict an alternate embodiment of a closure assembly constructed in accordance with the teachings of the disclosure. The elements of FIGS. 7-10 which are common with elements illustrated in the embodiment of FIGS. 1-6 are labeled with numerals exactly 100 greater than corresponding elements of FIGS. 1-6. A reservoir holder 122 holds ink (or other fluid) for delivery to an applicator element such as a writing point or nib 124. The reservoir holder 122 includes an extension 126 of reduced diameter extending from one end of the reservoir holder 122. A retention stop 132 and a protrusion 134 are located on the reservoir holder 122 proximate one end of the extension 126 for securing a closure assembly 160 to the reservoir holder 122. A biasing member 136 is disposed on the extension 126, the biasing member 136 provides extension and retraction force to the closure assembly 160.

Disposed on a distal end of the extension 126 is a valve 140 having a lid 142 hingedly attached to an open end of the valve 140. The valve 140 substantially surrounds the distal end of the extension 126 and the nib 124 when the nib 124 is in a fully retracted position. The valve 140 and the lid 142 cooperate to seal the nib 124 from the environment to prevent evaporation of ink (or other fluid) and premature drying of the nib 124. The lid 142 may be attached to the valve 140 by any known attachment means that allows the lid to be selectively moved away from the open end of the valve 140. For example, the lid 142 may be attached to the valve 140 with a living hinge 144 and the living hinge 144 may optionally bias the lid 142 to an open position. The biasing member 136 seats against a bottom surface 146 of the valve 140 to bias the valve 140 away from the reservoir holder 122. The valve 140 also may include one or more shoulders 148 for engaging a ledge (not shown in FIGS. 7-10) on an inner surface of the barrel (not shown in FIGS. 7-10). The valve 140 is held in a fixed position relative to the barrel by the biasing member 136 forcing the one or more shoulders 148 against the ledge, as in the embodiment shown in FIGS. 3-5.

The closure assembly 160 includes a closure ring 162 at one end and a retention ring 164 at another end. The closure ring 162 and retention ring 164 are spaced apart from one another and connected by at least one closure arm 166. The retention ring 164 is disposed on the reservoir holder 122 thus securing the closure assembly 160 to the reservoir holder 122. The retention ring 164 is longitudinally movable along a portion of the reservoir holder 122. Longitudinal movement of the retention ring 164 is limited in one direction by the retention stop 132. When the nib 124 is in the retracted position (FIGS. 7 and 9), the retention ring 164 is located between the protrusion 134 and the retention stop 132. When the nib is in the fully extended position (FIGS. 8 and 10), the retention ring 164 is located below the protrusion 134. In other words, in the fully extended or writing position, the protrusion 134 is located between the retention ring 164 and the retention stop 132. The closure ring 162 may include a beveled outer surface 168 and a corresponding angled, spherical or other shaped inner surface (not shown). The beveled outer surface 168 seats against a tapered inner surface of the nose section (not shown in FIGS. 7-10) when the nib 124 is in the fully extended position (FIGS. 8 and 10). The tapered inner surface and the beveled outer surface 168 cooperate to align and position the closure ring 162 so that the nib 124 extends through the barrel in a proper position. Likewise, the beveled, spherical or other shaped top surface of the lid 142 is guided into the closed position by the angled, spherical or other shaped inner surface of the closure ring 162.

Figure 7:
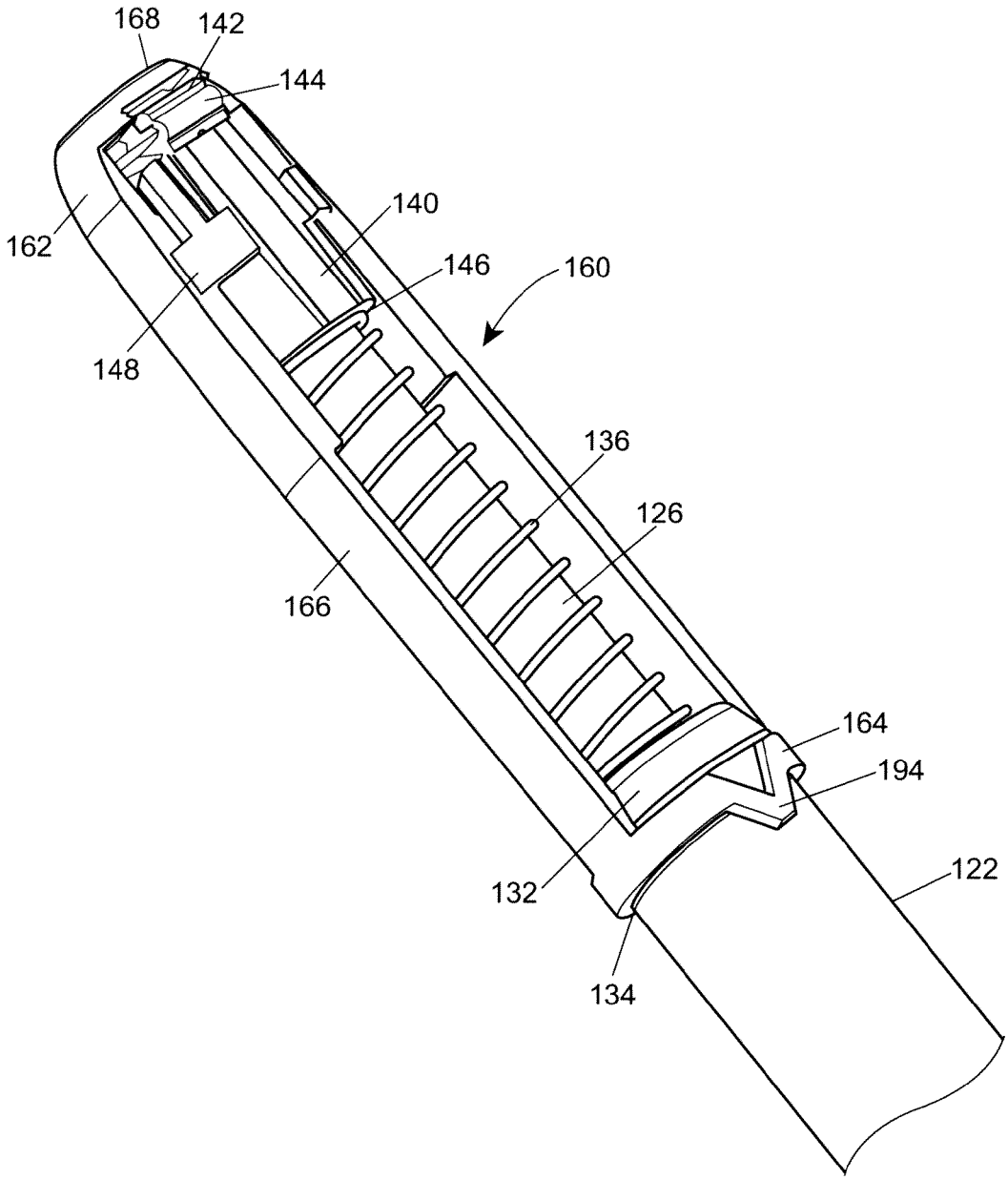
FIG. 7 is a perspective view of another alternate embodiment of a closure assembly constructed in accordance with the teachings of the disclosure, a nib of the writing instrument being in a fully retracted position.
Figure 8:
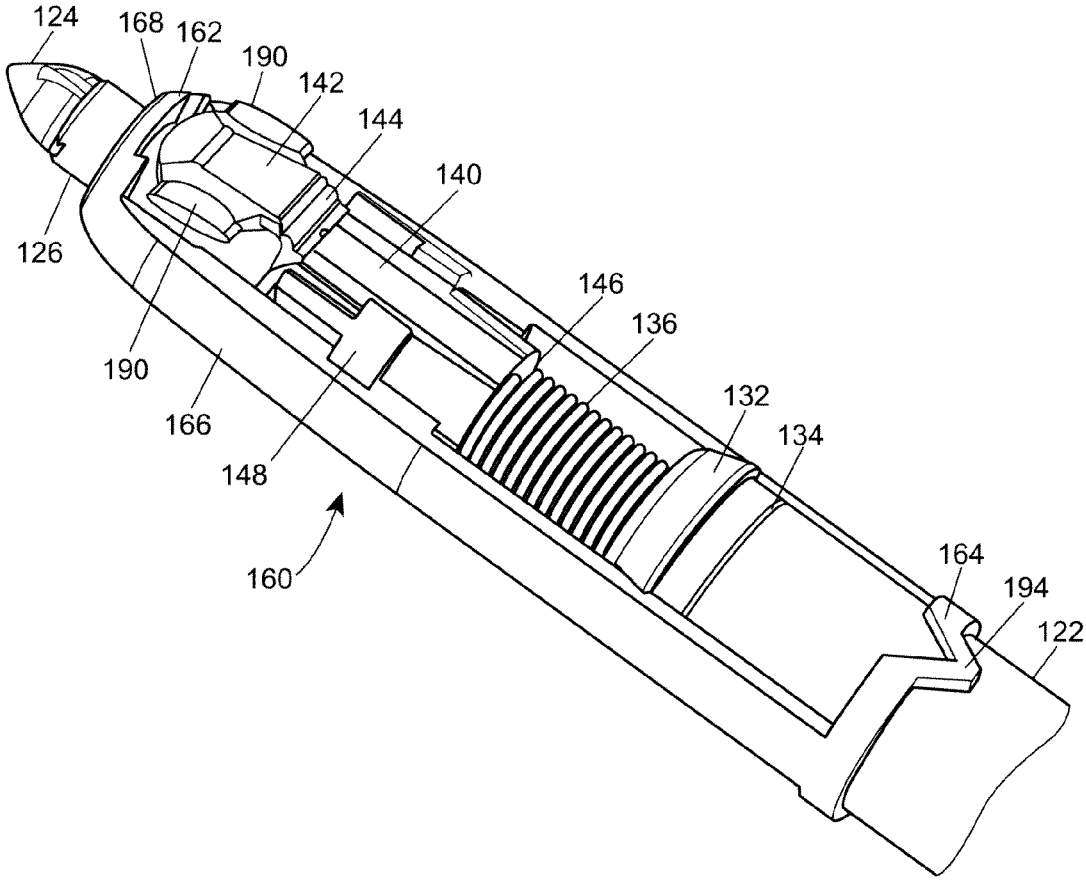
FIG. 8 is a perspective view of the closure assembly of FIG. 7, the nib being in a fully extended position.
Figure 9:
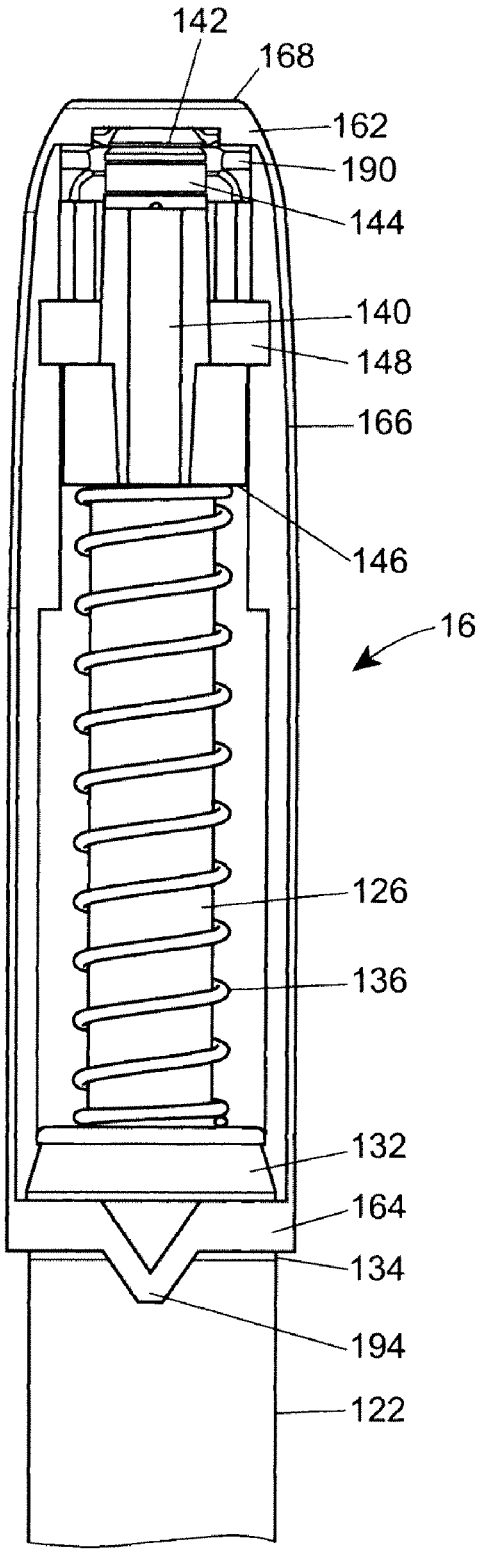
FIG. 9 is a side view of the closure assembly of FIG. 7, the nib being in a fully retracted position.
Figure 10:
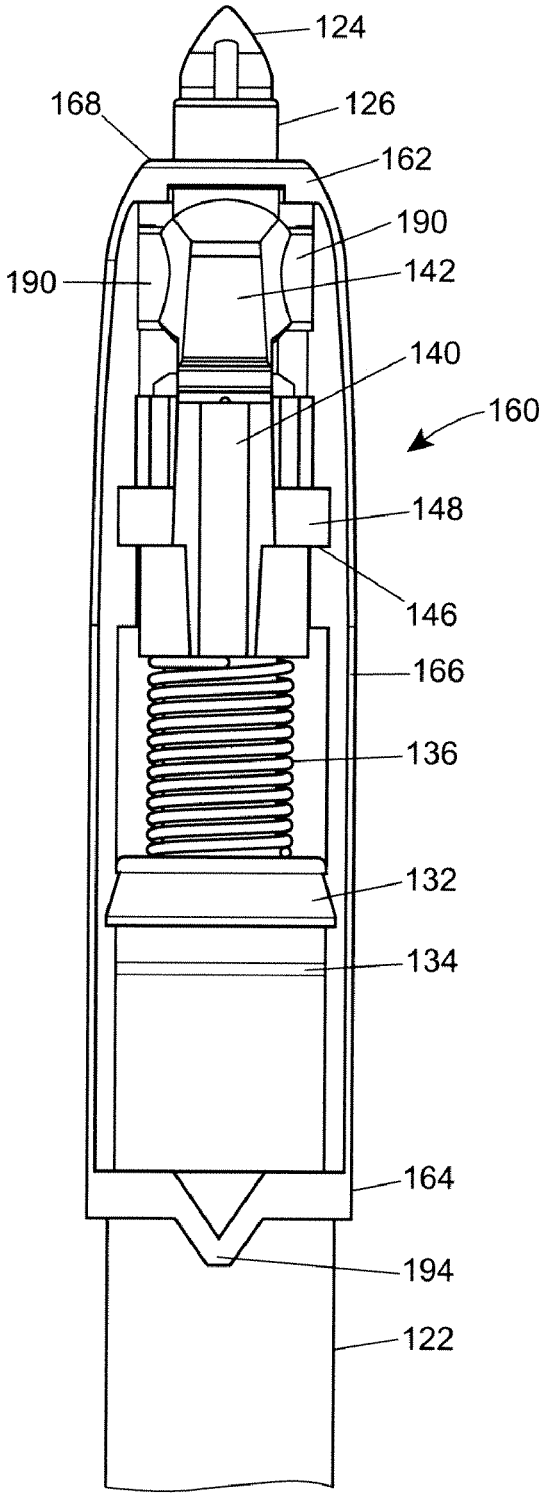
FIG. 10 is a side view of the closure assembly of FIG. 7, the nib being in a fully extended position.

In FIGS. 7 and 9, the valve 140 and lid 142 are in a closed and sealed position over the nib 124. The closure ring 162 maintains positive pressure on the lid 142. As the valve 140 is forced forward by activation of the actuator button, the closure ring 162 controls forward movement of the valve 140 and lid 142 thereby retaining positive sealing contact between the lid 142 and the valve 140. The retention ring 164 is prevented from forward movement by the retention stop 32.

The cap-less retractable writing instrument has a two stage protraction/retraction sequence. During the first stage, the reservoir holder 122 and the closure assembly 160 move relative to the valve 140 to open the lid 142 before the nib 124 impacts the lid 142. When a user pushes an actuator button (not shown in FIGS. 7-10), the reservoir holder 122 begins to move forward towards the opening in the barrel (not shown in FIGS. 7-10). The movement of the valve 140 is controlled by the interaction between the ledge and shoulder 148, as previously described. Because of the movement of the reservoir holder 122, the closure assembly 160 and the extension 126 also move forward. The retention ring 164 initially moves forward with the reservoir holder 122 because a frictional force is created by the interaction between the protrusion 134 and the retention ring 164 causing these elements to be temporarily coupled together, as previously discussed. As the closure ring 162 begins to move away from the valve 140, such that it is no longer in sealing contact with the lid 142 (i.e., after the interaction between the protrusion 134 and the retention ring 164 has been overcome), the lid 142 (normally biased to an open position by the living hinge 144) begins to open. In an alternate embodiment, the lid 142 may be forced or pushed open by coupling to the closure assembly 160 through, for example, cam surfaces as previously discussed. Advantageously, the lid 142 opens before the nib 124 contacts the lid 142. As a result, impact damage to the nib 124 and ink buildup on an inner surface of the lid 142 are prevented. Eventually, the closure ring 162 is prevented from further forward movement by contact with the inner tapered surface of the nose section (not shown in FIGS. 7-10), as previously described.

During the second opening stage, the reservoir holder 122 and extension 126 continue to move forward relative to the valve 140, the barrel 112, and the closure assembly 160. When the beveled surface 168 of the closure ring 162 seats against the tapered surface of the nose section, the closure assembly 160 becomes fixed with respect to the barrel and is prevented from further forward movement. At this point, the lid 142 is in the fully open position. Continued forward movement of the reservoir holder 122 eventually produces enough force to overcome the frictional force created by the interaction between the retention ring 164 and the protrusion 134. As a result, the retention ring 164 stops forward movement and the reservoir holder 122 continues forward movement relative to the closure assembly 160. In the fully protracted position, the protrusion 134 is located between the retention ring 164 and the retention stop 132. As the reservoir holder 122, the extension 126, and the nib 124 continue to move relative to the barrel, the valve 140 and the closure assembly 160, the nib 124 eventually extends out of the barrel and into the fully protracted writing position.

In the embodiment of FIGS. 7-10, the retention ring 164 is disposed over the reservoir holder 122, as opposed to being disposed over a retention arm which is integral with the reservoir holder (as in the embodiment of FIGS. 3-5). The retention stop 132 prevents forward movement of the retention ring 164 beyond the retention stop 132. The closure assembly 160 of FIGS. 7-10 advantageously eliminates the need for integral extension arms. Thus the closure assembly 160 of FIGS. 7-10 reduces the overall amount of material and assembly parts relative to the embodiment of FIGS. 3-5.

The retention ring 164 of FIGS. 7-10 includes one or more expansion features, such as a v-shaped notch 194. Any feature that allows a ring to expand under stress could be used. For example, any feature that temporarily allows the retention ring 164 to deform producing a larger diameter or circumference may be used. During assembly, the retention ring 164 is slid over the extension 126, valve 140, and biasing member 136. As the retention ring 164 is forced over the retention stop 132, the v-shaped notch 194 is expanded into a more linear orientation, thus increasing a circumference of the retention ring 164 to allow the retention ring to pass over the retention stop 132 and into its proper position on the reservoir holder 122. Once the retention stop 132 is cleared, the v-shaped notch 194 returns to its original shape, thus reducing the circumference of the retention ring enough so that the retention ring 164 will not slide off of the reservoir holder 122 (i.e., forward movement of the retention ring 164 will be controlled by the retention stop 132).

Assembly of the cap-less retractable writing instrument may generally occur in the following order. First, the biasing member 36, 136 is placed over a portion of the reservoir holder 22, 122. Next, the valve 40, 140 is placed over the nib 124 resting on a portion of the reservoir holder 22, 122. Subsequently, the valve 40, 140 and biasing member 36, 136 are captured and retained by placing the closure assembly 60,

160 over the valve 40, 140 and the biasing member 36, 136. Finally, the closure assembly 60, 160, valve 40, 140, biasing member 36, 136, and reservoir holder 22, 122 are captured and retained by being placed inside the barrel 12. Thus, assembly of the disclosed cap-less retractable writing instrument does not involve sub-assemblies of any sort. As a result, manufacturing time and overall part counts are advantageously decreased. In an alternative assembly order, the valve 40, 140 may be inserted into the closure assembly 60, 160 prior to placing the closure assembly 60, 160 over the biasing member 36, 136 and the reservoir holder 22, 122.

The above disclosed valves, closure assemblies, reservoir holders, and barrels may be formed from any material or combination of materials that produce limited flexibility and durability. Such materials include, but are not limited to thermoplastic elastomers, and conventional thermoplastics such as polypropylenes, nylons, etc.

Notwithstanding the disclosure that the cap-less retractable writing instruments specifically illustrated herein include a biasing member, such as a spring to generate opening and closing forces, a variety of force generating mechanisms or biasing members can be used including but not limited to helical springs, leaf springs, etc.

Moreover, the closure assemblies, valves, and lids may be used on virtually any instruments having a lid. For example, as will be appreciated by one of skill in the art, the closure assemblies as described above may be used in various retractable writing instruments such as highlighters, markers, felt-tipped pens, ball point pens, and the like. In addition to writing instruments, the closure assemblies are also applicable to a variety of other fluid application tools including, but not limited to paint brush applicators, correction fluid applicators, make-up applicators, such as nail polish and mascara applicators, and perfume applicators. Further, the retractable mechanism could be used in conjunction with other tools such as thermometers, pH detectors, knives, fluid sampling devices, flash lights, laser pointers, and the like. In the case of retractable tools, the tool may be disposed on a tool holder, the valve and lid selectively covering the tool.

For example, a retractable tool may include a tool extending from a tool holder, and a valve covering the tool and protecting the tool from environmental factors. A closure assembly may retain the valve on the tool holder, the closure assembly including a closure ring, a retention ring and at least one closure arm. The closure assembly may be retained on the reservoir holder by a retention stop.

Although certain retractable instruments have been described herein in accordance with the teachings of the present disclosure, the scope of coverage of this patent is not limited thereto. On the contrary, while the invention has been shown and described in connection with various preferred embodiments, it is apparent that certain changes and modifications, in addition to those mentioned above, may be made. This patent covers all embodiments of the teachings of the disclosure that fairly fall within the scope of permissible equivalents. Accordingly, it is the intention to protect all variations and modifications that may occur to one of ordinary skill in the art.

What is claimed is:

1. A cap-less retractable writing instrument comprising:

a writing nib extending from a reservoir holder;

a valve and a lid selectively sealing the writing nib, the valve and the lid being disposed on one end of the reservoir holder; and a closure assembly comprising:

a closure ring;

a retention ring spaced apart from the closure ring;

at least one closure arm connecting the closure ring and the retention ring;

a curved cam surface on an inner surface of the at least one closure arm, the curved cam surface interacting with the lid during protraction of the lid to open the lid prior to the nib contacting the lid; and at least one tab on the lid, the at least one tab riding on the cam surface during protraction of the nib, wherein the closure assembly retains the valve, the closure assembly being secured to the reservoir holder by a retention stop disposed on the reservoir holder, the retention stop being integral with the reservoir holder.

2. The cap-less retractable writing instrument of claim 1, wherein the reservoir holder comprises an integral retention arm and the retention stop is disposed on the integral retention arm.

3. The cap-less retractable writing instrument of claim 2, wherein the retention arm is deformable with respect to the reservoir holder.

4. The cap-less retractable writing instrument of claim 1, wherein the retention ring includes an expansion feature that allows a circumference of the retention ring to temporarily expand when the retention ring is stressed.

5. The cap-less retractable writing instrument of claim 4, wherein the expansion feature is a v-shaped notch.

6. The cap-less retractable writing instrument of claim 1, further comprising a protrusion on the reservoir holder, the protrusion producing a frictional force to temporarily couple the retention ring to the reservoir holder during protraction of the nib.

7. The cap-less retractable writing instrument of claim 6, wherein the protrusion is disposed on a retention arm that is integrally formed with the reservoir holder.

8. The cap-less retractable writing instrument of claim 1, further comprising a barrel enclosing the reservoir holder, the valve, and the closure assembly, the barrel including at least one guide rail disposed on an inner surface of the barrel proximate the valve.

9. The cap-less retractable writing instrument of claim 1, wherein the valve includes at least one notch in an outer surface thereof, the notch being sized to receive at least a portion of the at least one closure arm.

10. The cap-less retractable writing instrument of claim 1, wherein the lid remains in contact with the closure assembly throughout protraction and retraction of the writing nib.

11. The cap-less retractable writing instrument of claim 1, wherein the closure ring includes an inner angled surface, the inner angled surface being sized to receive a portion of the lid during retraction of the writing nib.

12. The cap-less retractable writing instrument of claim 1, further including a barrel, the barrel having an opening at one end including a tapered inner surface, wherein the closure ring includes an outer beveled surface that seats against the tapered inner surface of the barrel during protraction of the writing nib.

13. The cap-less retractable writing instrument of claim 1, further including a barrel, the barrel having a ledge on an inner surface thereof, the ledge preventing forward movement of the valve relative to the barrel.

14. The cap-less retractable writing instrument of claim 1, wherein the lid remains between the closure ring and the valve during protraction and retraction of the nib.

15. The cap-less retractable writing instrument of claim 1, wherein protraction of the nib is a two-stage protraction in which the reservoir holder and the closure assembly move relative to the valve during the first stage and the reservoir holder moves relative to the valve and the closure assembly during the second stage.

* * * * *